United States Patent [19]

Hill

[11] 4,309,965

[45] Jan. 12, 1982

[54] VERTICAL FEED STICK WOOD FUEL BURNING FURNACE SYSTEM

[75] Inventor: Richard C. Hill, Orono, Me.

[73] Assignee: Board of Trustees of the University of Maine, Bangor, Me.

[21] Appl. No.: 75,815

[22] Filed: Sep. 14, 1979

[51] Int. Cl.[3] ..... F22B 5/00

[52] U.S. Cl. ..... 122/15; 110/234; 126/361; 126/74; 122/136 R

[58] Field of Search ..... 126/101, 367, 368, 74, 126/75, 361; 237/8 R, 56; 122/136 R, 141 A, 15; 110/234

[56] References Cited

U.S. PATENT DOCUMENTS

| | | | |
|---|---|---|---|
| 248,496 | 10/1881 | Neahous | 110/184 |
| 413,039 | 10/1889 | Eaton | 126/368 |
| 1,468,561 | 9/1923 | Friend | 126/367 |
| 2,327,339 | 8/1943 | Chandler | 237/8 R |
| 3,999,709 | 12/1976 | Estabrook | 237/59 |
| 4,102,279 | 7/1978 | Gröschl et al. | 110/234 |

*Primary Examiner*—William E. Wayner
*Assistant Examiner*—Henry Bennett
*Attorney, Agent, or Firm*—Daniel H. Kane, Jr.

[57] ABSTRACT

A stove or furnace for efficient combustion of wood fuel includes a vertical feed combustion chamber (15) for receiving and supporting wood fuel in a vertical attitude or stack. A major upper portion of the combustion chamber column comprises a water jacket (14) for coupling to a source of water or heat transfer fluid for convection circulation of the fluid. The locus (31) of wood fuel combustion is thereby confined to the refractory base of the combustion chamber. A flue gas propagation delay channel (34) extending laterally from the base of the chamber affords delayed travel time in a high temperature refractory environment sufficient to assure substantially complete combustion of the gaseous products of wood burning with forced air prior to extraction of heat in heat exchanger (16). Induced draft draws the fuel gas and air mixture laterally through the combustion chamber and refractory high temperature zone to the heat exchanger and flue. Also included are active sources of forced air and induced draft, multiple circuit couplings for the recovered heat, and construction features in the refractory material substructure and metal component superstructure.

29 Claims, 13 Drawing Figures

VERTICAL FEED STICK WOOD FUEL BURNING FURNACE SYSTEM

The U.S. Government has rights in this invention pursuant to Contract No. EC-77-S-02-4559 awarded by the U.S. Department of Energy. Waiver of domestic rights in this invention was granted to the University of Maine on Jan. 15, 1980. Foreign rights were previously released by the Government to the University of Maine on Apr. 30, 1979. Domestic and foreign rights are subject to the provisions under 41 CFR 9-9.109-6, 41 CFR 9-9.107-5(a), DOE Confirmatory License Format B and Agreement Format D.

FIELD OF THE INVENTION

This invention relates to new and improved wood fuel burning systems including stoves, furnaces and boiler units, designed for efficient and complete combustion of wood fuel and for recovery and transfer of heat from the end products of wood fuel combustion for multiple uses.

BACKGROUND OF THE INVENTION

A series of very complex time and temperature dependent chemical reactions accompany the burning of wood, making it difficult to supply the correct amount of air and to control the output to match a particular heating load. This difficulty in carburetion and control of wood fuel combustion is compounded by complexities of ignition. The pyrolysis gases generated from heating wood have ignition temperatures over a range from 725 degrees for methanol to 1128 degrees for carbon monoxide. Since conventional wood stove and wood furnace surface temperatures do not attain this range, much of the gas distilled from wood during burning is vented up the chimney. Conventional wood stoves and furnaces therefore suffer undesirable consequences of inefficient loss of fuel energy, pollution of the atmosphere, and chimney condensation or "creosote" deposits with subsequent fire hazard.

As a piece of wood is burned, heat is transferred from the surface to the interior of the wood, with a counterflow of pyrolysis material from the interior to the surface. The kinetics of the reaction depend upon many factors including the surface to volume ratio of the wood piece, surface temperature including radiant field and convection field, wood moisture, wood species, and rate of air supply. This complexity of parameters conspires to produce considerable variation in output and performance in conventional wood stoves and furnaces.

It is therefore an object of the present invention to provide a new and improved wood furnace system design and method which maintain the combustion zone at sufficient temperature and turbulence and which maintain the pyrolysis gases generated by wood burning in the high temperature combustion zone for a sufficient time to permit substantially complete combustion of wood pyrolysis materials. According to the invention the chemical reactions accompanying the burning of wood are substantially completed in a high temperature delayed propagation zone prior to heat exchange from the end products of combustion, thereby greatly reducing inefficient loss of fuel energy, pollution of the atmosphere, and chemical condensation in the chimney.

Another object of the invention is to provide a wood stove or furnace with a confined locus of wood fuel combustion in a high temperature environment and for gravity feed of the wood fuel into the confined locus of efficient combustion by progressive burning from the bottom of the charge of wood, thereby providing a steady state burn and steady state output from the furnace system as the charge of wood fuel is consumed.

A further object of the invention is to provide a multiple use furnace and boiler unit for house and building heating, domestic hot water use, and for hot water storage derived from a safe, stable and reliable form of wood fuel combustion.

SUMMARY OF THE INVENTION

In order to accomplish these results, the present invention contemplates providing a new and improved stove or furnace for efficient combustion of wood fuel in the form of sticks, logs or other elongate pieces of wood or wood in vertical stack. A substantially vertical feed combustion chamber forming an upright column receives and supports wood fuel in a near vertical attitude. The combustion chamber is substantially airtight and formed with a laterally directed draft outlet at the base of the combustion chamber. According to the invention, a major upper portion of the combustion chamber column comprises a water jacket and means for coupling the water jacket to a source of water or other heat transfer fluid for at least convection circulation of water or fluid through the water jacket thereby confining the locus of wood fuel combustion to the bottom of the vertical feed combustion chamber.

The invention also contemplates providing a flue gas delay propagation channel extending from the laterally directed draft outlet at the bottom of the combustion chamber, and a heat exchanger coupled to the output of the flue gas delay channel for receiving the hot gaseous end products of wood combustion and transferring heat from the gases to another medium. A feature and advantage of this arrangement is that the flue gas propagation channel affords delayed propagation of a flue gas and forced air mixture in a high temperature environment sufficient to afford substantially complete secondary burning of the gaseous products and constituents of wood burning and all prior to heat transfer in the heat exchanger.

The invention further contemplates providing an induced draft from the base of the combustion chamber through the delayed propagation channel and heat exchanger for laterally directing the draft away from the locus of wood fuel combustion and away from the vertically oriented charge of fuel. In addition to actively inducing the draft, the invention contemplates actively forcing air into the combustion chamber base portion to effect turbulent mixing and swirling of air with the gaseous products of wood fuel pyrolysis. A feature and advantage of this arrangement is that a turbulent mixture of air and fuel gas follows the draft from the base of the combustion chamber through the laterally directed channel where the travel time in a high temperature environment permits substantially complete secondary burning of the flue gases. Heat exchange following the chemical reaction phase thereafter affords low stack temperatures.

According to a preferred embodiment of the invention the combustion chamber with elongate vertical axis comprises a base portion of refractory material forming the locus of wood fuel combustion, and a water jacket defining the walls of a vertical column positioned over the combustion chamber refractory base portion and forming a substantially airtight enclosure over the base portion. The combustion chamber base portion and the vertical column water jacket in combination define the substantially vertical feed combustion chamber for receiving elongate pieces of wood or wood in a vertical stack with the bottom end of the wood fuel resting in the refractory base portion so that the wood fuel is gravity fed into the locus of wood fuel combustion by burning progressively from the bottom. As used herein and in the claims, "substantially vertical" in reference to the axis or walls of the combustion chamber and with reference to the orientation and attitude of the wood fuel includes not only a vertical configuration but also a range of variation about the vertical but with sufficient declivity so that gravity may overcome any frictional forces or coefficient of friction between the wood fuel and the walls of the combustion chamber.

The laterally directed slow propagation flue gas channel extending from the base of the combustion chamber is similarly bounded by refractory material insulating the path to maintain the high temperature environment over a sufficient travel time to permit substantially complete combustion. The heat exchange section may also comprise a base portion of refractory material for receiving the hot gases of wood fuel combustion from the refractory channel with the heat exchanger positioned over the refractory base portion. A feature and advantage of this arrangement is that the flue gas and forced air mixture from the locus of wood fuel combustion is initially confined in its travel to a high temperature refractory and insulated environment for confinement of heat and maintenance of high temperature for a sufficient time to permit the complete combustion. The induced draft and forced air pressure and flow are adjusted and matched to achieve a temperature in the high temperature environment bounded by the refractory portions of the furnace of at least 1128 degrees Fahrenheit and preferably in the range of 1200 degrees Fahrenheit to 2000 degrees Fahrenheit, a range in which all of the flue gas wood products are completely reacted. On the other hand, stack or chimney temperature following the heat exchanger is relatively low.

From another perspective, the preferred embodiment of the furnace system of the present invention comprises a base portion of refractory insulating material forming in sequence a combustion chamber base and locus of wood fuel combustion, a flue gas channel extending laterally from the combustion chamber base, and a heat exchanger base for supporting the heat exchanger. The base portion is formed or lined with precast refractory bricks or sections, or is formed of refractory material cast in situ and in the preferred embodiment includes at least a layer of heavy refractory cement and a layer of lighter insulating refractory material. The metal portion of the furnace system includes the combustion chamber water jacket positioned over the combustion chamber and forming an airtight cover and the heat exchanger positioned over the heat exchanger base portion.

From this perspective the actively induced draft is established through the sequence of the refractory base portion of the furnace system from the locus of wood fuel combustion through the lateral high temperature environment delay channel, to the refractory base of the heat exchanger. Combustion air actively forced into the refractory base of the combustion chamber and the locus of wood fuel combustion therefore turbulently mixes with the primary gases of wood burning, and intermixed, follows the course through the refractory base sequence.

According to another embodiment at least the heavy refractory linings of the refractory base portion are separately precast as a first substantially vertical axis cast hollow cylinder forming the inner lining of the combustion chamber base wall, a second substantially vertical axis cast hollow cylinder forming the inner lining of the heat exchanger base wall, and a third elongate case hollow cylinder of smaller diameter and substantially lateral axis orientation forming the lateral delay channel between the combustion chamber base and the base of the heat exchanger. The first, second and third hollow cylinders may then be embedded in a casting of light weight insulating refractory mixture for added insulation of the base portion of the furnace system. Hard fire bricks are imbedded in the inside surface of the bottom of the combustion chamber base better to withstand the impact and weight of elongate pieces of wood.

According to additional features, a source of water or heat transfer fluid may be coupled for convection circulation of said fluid through the combustion chamber water jacket and through said heat exchange means in parallel fluid circuits, with the heat transfer fluid confined at ambient atmospheric pressure for safety purposes. The invention thus affords an ambient atmospheric pressure boiler system. In addition a domestic hot water supply heat exchanger can be provided in a heat transfer fluid circuit in parallel with the combustion chamber water jacket, heat exchange means, and source of heat transfer fluid and with a fluid pump to increase the rate of heat exchange to the domestic hot water supply.

In addition to hardware and systems, the invention contemplates a new and improved method for efficient combustion of wood fuel in the form of sticks, logs, or other elongate pieces, or wood in a vertical stack, and for extracting heat from the hot gaseous end products of such wood fuel combustion including the steps of supporting a charge of wood in a substantially vertical attitude; burning the bottom of the vertically oriented wood fuel in a high temperature environment; cooling the upper portion of the charge of wood fuel to confine the locus of wood fuel combustion to the bottom portion or base of the vertically oriented fuel; gravity feeding the fuel into the locus of combustion as burning progresses from the bottom; inducing a draft across the base of the fuel and laterally away from the locus of combustion; forcing air into the locus of combustion and turbulently mixing the air with the gaseous products of combustion; conducting the laterally drafted fuel and air mixture in a high temperature environment prior to the heat exchanging step for a sufficient delay time to permit substantially complete secondary burning of the products and constituents of the burning wood fuel; and finally exchanging heat from the gaseous end products of substantially complete secondary burning of the products and constituents of the burning wood fuel. Another feature of the method includes matching and balancing the induced draft and forced air. The volume of flow of forced air and flue draft is regulated for maintaining the temperature in the locus of wood fuel combustion and in the lateral draft high temperature environment at least at 1128 degrees F. and preferably in the range of 1200 degrees F. to 2000 degrees F.; and substantially extracting heat from the end products of combustion so that flue stack or chimney temperatures are at or below 300 degrees F.

Other objects, features and advantages of the invention will become apparent in the following detailed specification and accompanying drawings.

PRIOR ART STATEMENT

U.S. Pat. No. 4,046,320 describes a fireplace boiler with three water circulating and water handling components in series including the five-sided open front fireplace water jacket, conventional furnace boiler, and space heating radiators. The fireplace boiler or heat exchanger also includes a grate which supports a log fire but in the traditional horizontal log orientation. The water circulating panels and grate form a water circulating "jacket" around part of the combusting wood fuel but this water jacket is merely for water heating and does not serve the function of the water jacket in the vertical feed stick wood furnace system of the present invention in confining the locus of combustion to the bottom of a vertically oriented charge of wood.

U.S. Pat. No. 4,131,231 describes another fireplace waterjacket arrangement and water heating and circulating system but is otherwise an open hearth fireplace with horizontal log fire as is also the fireplace waterjacket described in U.S. Pat. No. 2,006,279. Traditional water heating and circulating plumbing arrangements are represented by U.S. Pat. No. 1,731,368, while a more recent energy recovery and hot water storage and heater system is described in U.S. Pat. No. 4,037,786. U.S. Pat. No. 4,127,107 describes an auxiliary hot water heating system or preheater using a drum shaped water jacket arrangement around a horizontal cylindrical wood log combustion chamber. Again, the outstanding features of the present invention are not present.

U.S. Pat. No. 2,345,329 describes an improvement in wood burning stoves whose principle object is to provude a stove that can be stocked with fuel which will feed downwardly into the fire area or draft line as the underlying fuel is consumed. The draft is drawn off from the base of the fuel and then passes through a passageway around the upper portion of the fuel. Thus, instead of cooling the upper portion of the fuel as in the present invention, the hot gases would increase the temperature, and confinement of the locus of burning to the base of the firebox would seem highly problematic in this arrangement. None of the other features of the present invention are disclosed, nor is there a refractory base portion, and this patent is primarily concerned with an air heat exchanging wood stove.

U.S. Pat. No. 4,126,119 describes a furnace with a firebox designed for delivering logs horizontally along rollers in an enclosure into the side of the combustion chamber. Water spray heads are provided near the firebox end of the enclosure so that any back flames can be doused. Similarly, in this patent, no other related features of the vertical feed stick wood furnace system of the present invention are described. U.S. Pat. No. 121,361, an older patent, describes a "magazine" for vertical feed of solid fuel into a combustion chamber, typical of patents on such fuel magazines particularly for feeding coal into a furnace or stove.

DESCRIPTION OF THE PREFERRED EMBODIMENT

Figure 1:
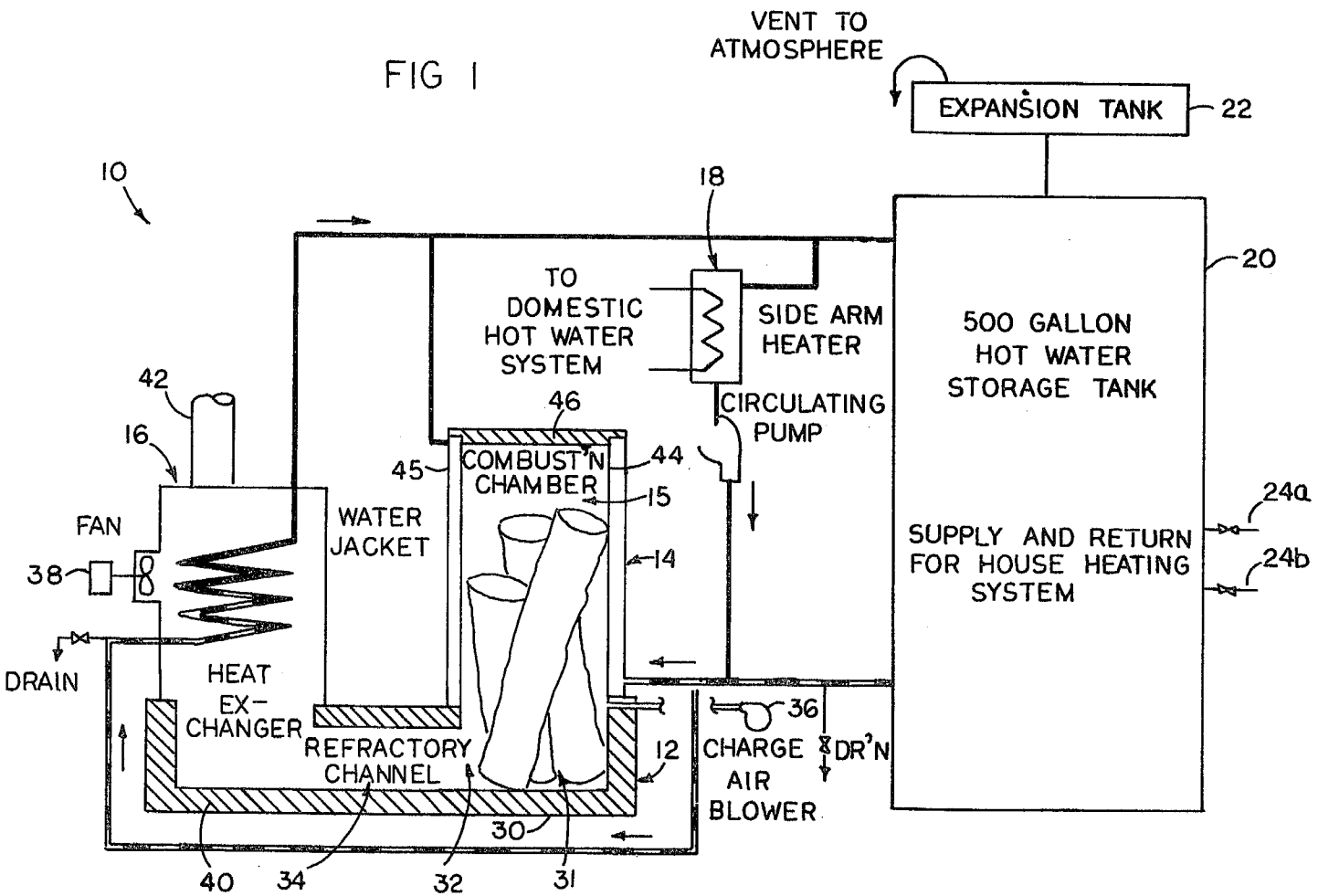
FIG. 1 is a diagrammatic view with partial cross sections of the vertical feed stick wood furnace system of the present invention.
Figure 2:
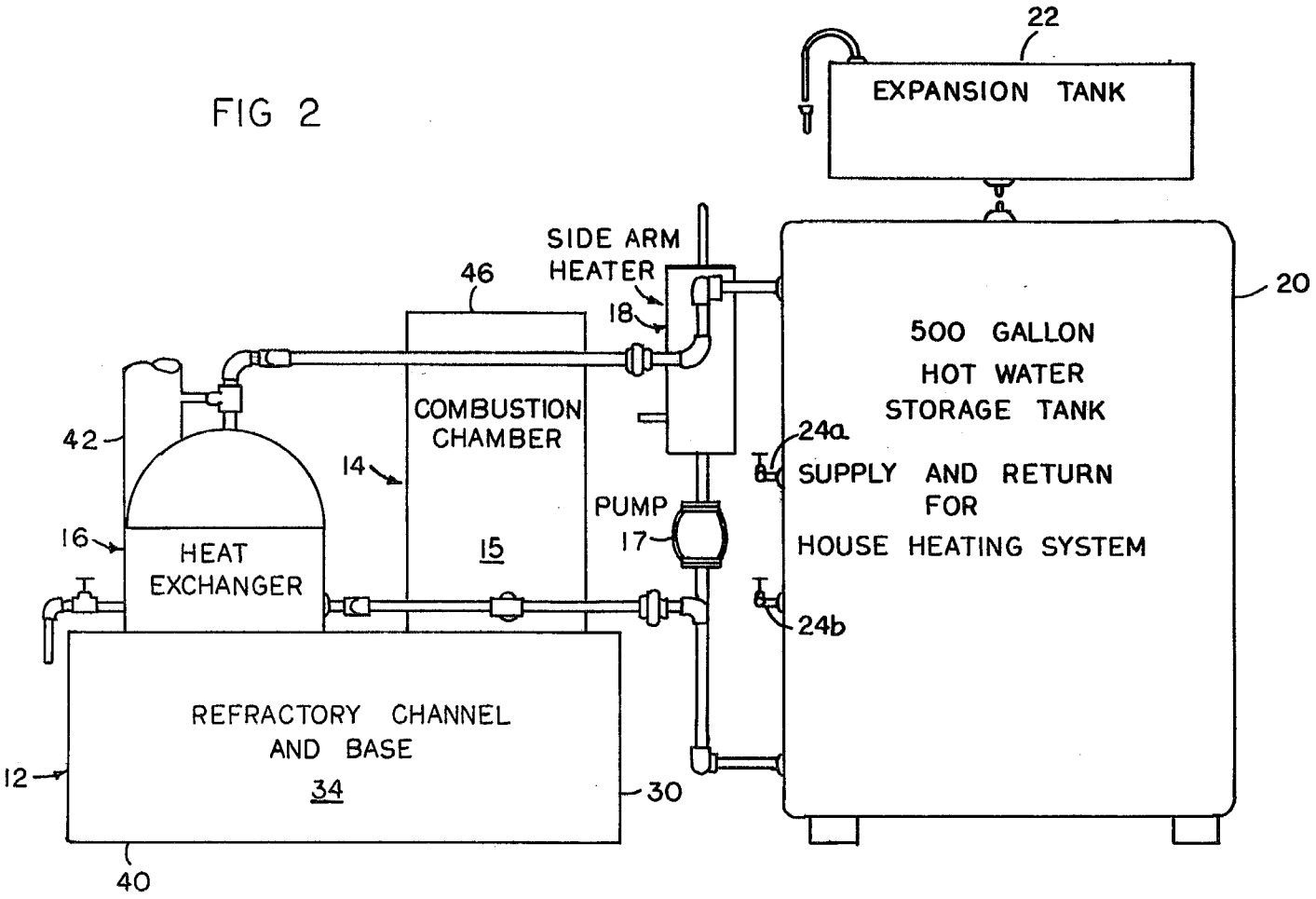
FIG. 2 is a side elevation view of the furnace system including the various components and water circulating couplings.
Figure 5:
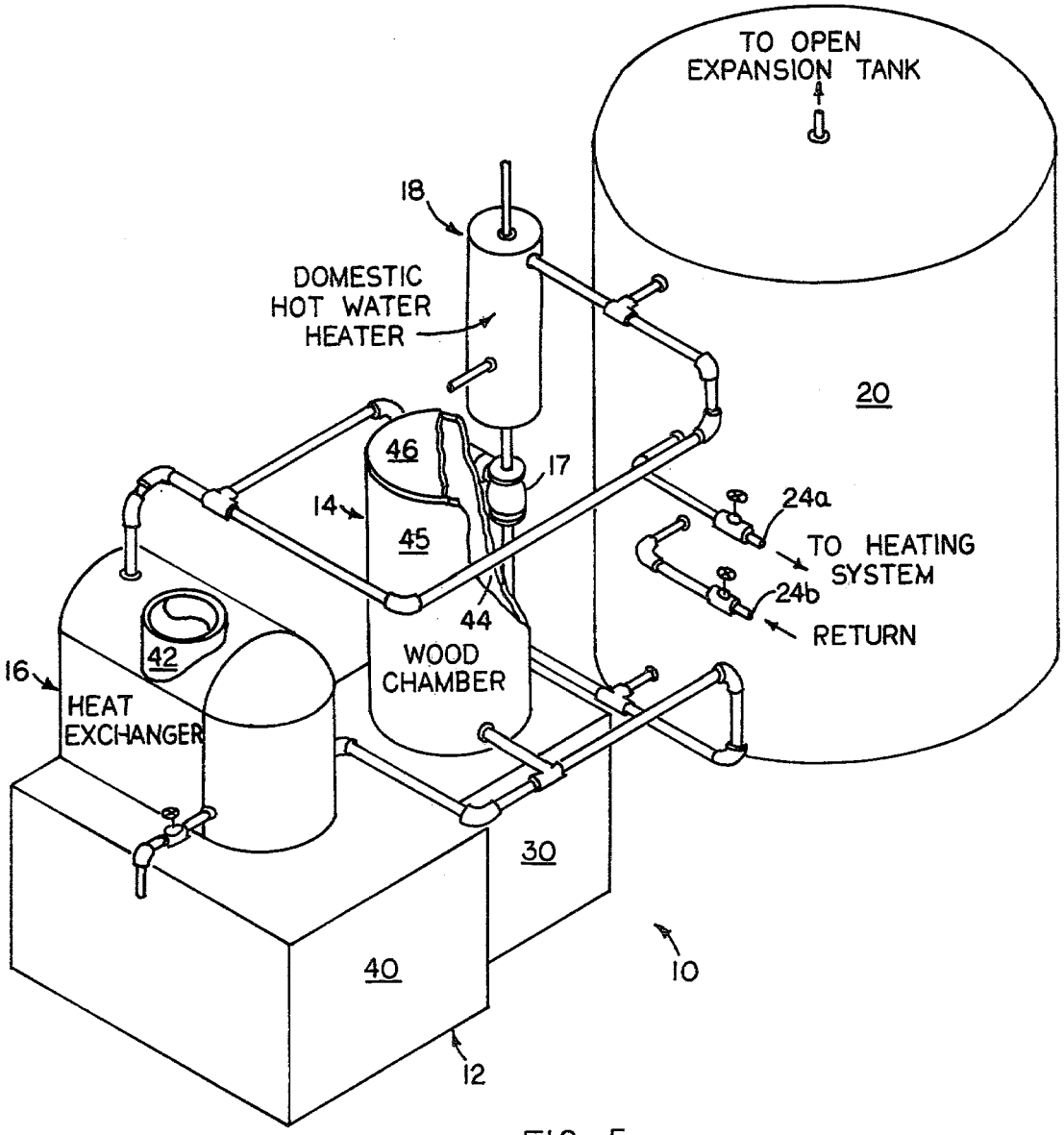
FIG. 5 is a perspective view of the furnace system with combustion chamber water jacket partially cut away.

In the embodiment of the present invention illustrated in FIGS. 1, 2 and 5 there is shown a wood furnace and boiler system 10 according to the present invention. The furnace system includes a base portion 12 of refractory material and a superstructure of metal components and elements including the combustion chamber water jacket 14, heat exchanger 16, and interconnecting plumbing as hereafter described. Also included in the system 10 is a domestic hot water heat exchanger 18 and a hot water storage tank 20 which opens to a safety expansion tank 22 in turn open to ambient atmospheric pressure. The storage source of hot water or other heat transfer fluid is thus confined so that it is open to ambient atmospheric pressure for safety reasons, and pressure is limited to the level of water in the storage tank 20. Also coupled to the storage tank 20 are the supply line **24*a* and return line 24*b* for a house or building heating system not shown. As shown in the Figures, the heat exchanger 16, combustion chamber water jacket 14, domestic hot water heater 18, and building heating system supply and return 24 are all coupled in parallel circuits or fluid lines with the hot water storage tank 20. The domestic hot water heat exchanger circuit or line may include a pump 17** in the heating fluid or heating water line for more rapid transfer of heat to the domestic hot water supply.

The combustion chamber section 15 of the furnace system is formed with a chamber base portion 30 made of refractory material generally including at least a heavy refractory cement layer and a light weight refractory insulating layer as further described. This chamber base 30 is part of the refractory base 12 of the furnace system, defines the locus 31 of wood fuel combustion at the base of the chamber and is formed with the laterally directed outlet 32 at the base of the combustion chamber 15, leading into the flue gas propagation delay channel 34 also contained within the refractory base portion 12 of the furnace system 10. This delay channel 34 surrounded by insulating refractory material affords the time delay in a high temperature environment for substantially complete combustion of the pryolysis products of wood burning. The products of wood burning are first subjected to turbulent mixing with charged air from charged air or forced air blower 36 which introduces forced air at the perimeter of the combustion chamber base 30. The mixture of air and incompletely burned gaseous fuel products follows the draft from the base 30 of the combustion chamber through the laterally directed refractory delay channel 34 induced by the draft inducer fan 38.

Chemical reaction of the gaseous fuel products and air is substantially complete as the flue gas enters the base portion 40 which supports the heat exchanger 16 and receives the end products of combustion. This heat exchanger base portion 40 is similarly part of the refractory base section 12 of the furnace system and directs the hot flue gas end products into the passageways of the heat exchanger 16 finally leading to the chimney or outlet flue 42. The draft inducing fan or other low pressure inducer may also be positioned in the outlet flue 42.

The combustion chamber water jacket 14 includes an inner wall 44 and an outer coaxial wall 45, made for example of boiler plate steel and defining the water jacket space around the upper portion of the combustion chamber within which circulates water or other heat transfer fluid from storage tank 20. The water jacket defines the major portion and the upper portion of the vertical axis combustion chamber and must be substantially air tight because of the induced draft. The water jacket and chamber is therefore fitted with an air tight cover 46 using high temperature gasket material or machined surfaces, etc. By means of the water jacket and air tight enclosure, fire is prevented from climbing from the locus of wood fuel combustion at the base of the chamber up the column of wood fuel vertically oriented in the combustion chamber. Thus, the action of the air-lean mixture toward the top of the chamber and the quenching action of the water jacket in which the circulating water temperature is about 200 degrees F., combine to confine combustion to the refractory base portion of the combustion chamber.

In operation of the furnace as by starting a fire or adding wood fuel to the combustion chamber, the cover 46 is removed only after the forced air blower or source 36 is turned off or lremoved and when the induced air blower or source 38 has established a draft from the base 30 of the combustion chamber through the delay channel 34, heat exchanger base 40 and heat exchanger 16 to the outlet flue. With the draft established and the forced air shut off, house or building air will enter the combustion chamber hole or opening at cover 46 when the cover is removed and until it is replaced, and no smoke will enter the building. During initial start up it is preferable to use sticks or elongate pieces of wood of 2 inches diameter or less, but once the refractory base portion is up to operating temperature of greater than 1128° F., single large diameter unsplit logs also burn satisfactorily. The combustion chamber is also provided with a low resistance air flow port not shown for flooding air into the chamber during start up and for providing a source of air for the draft fan to draw through the furnace sequence during operation. A valve or cover operates this port.

By way of example, a combustion chamber of 16" diameter, overall height in the range of 3 to 4 feet with a water jacket height of 30", can be loaded with forty pounds of stick wood, logs or elongate pieces of wood in a vertical orientation or small wood pieces in a vertical stack. A half or quarter horsepower induced draft fan is located in the vicinity of the flue gas outlet reducing the pressure within the furnace below atmospheric pressure by 0.3" to 0.7" of water. The charge air source is actuated to deliver air under pressure above atmospheric pressure by approximately 3" of water, and air flow is balanced with the draft inducer to provide approximately half the volume of stack flow of 60 cubic feet per minute. Under these conditions and with operating temperatures of 1200° F. to 2000° F. the charge of wood fuel burns at a steady rate with constant heat release and constant stack temperature of about 300° F. for a two hour burn, and a wood fuel consumption rate of twenty pounds of wood per hour. The heat output is in the order of 100,000 BTU's per hour. Additional wood can be added at any time without changing the steady state output and to prolong the steady state output of the furnace, with the forced air shut off prior to removing the cover 46 and loading the fuel. Furthermore, a thermostat can be provided in the stack or flue outlet coupled to shut off both the forced air and induced draft sources when the stack temperature falls below, for example, 250 degrees F. At this point only coals are left in the combustion chamber and the natural stack and flue draft will keep odors from the building. When small diameter sticks are used or added during the burn, a reduced air flow may be required to prevent fuel-rich-air-lean mixtures from "bumping", i.e. from causing small explosions within the combustion chamber that drive smoke out around the charging door 46.

The storage tank 20 may be for example a 500–600 gallon steel or lined concrete block tank storing up to 500,000 BTU energy which will protect a building for several hours or several days depending upon the weather and the building size and insulation. Piping between the storage tank and the combustion chamber water jacket and the heat exchanger is sized large enough for gravity and convection circulation, so that no circulating pump is needed in these lines. With R20 insulation, a 500 gallon tank will lose only 500 BTU's per hour so that heat loss from storage is not critical. When the furnace is not operating the air flow through the furnace is near zero so that stand-by heat loss is minimal compared with conventional oil and gas furnaces. In terms of safety, no high limit control is needed as the 500 gallon storage tank will absorb a full wood charge without overheating. Furthermore, the expansion tank 22 above the tank 20 is open to the atmosphere so that no over-pressure is possible. In terms of stack safety, the complete combustion precludes chimney deposits.

The heat exchanger 16 may be a heat exchange unit of the type manufactured by Axeman-Anderson, of Williamsport, Pa., referred to as the Axeman-Anderson Unit.

Figure 3:
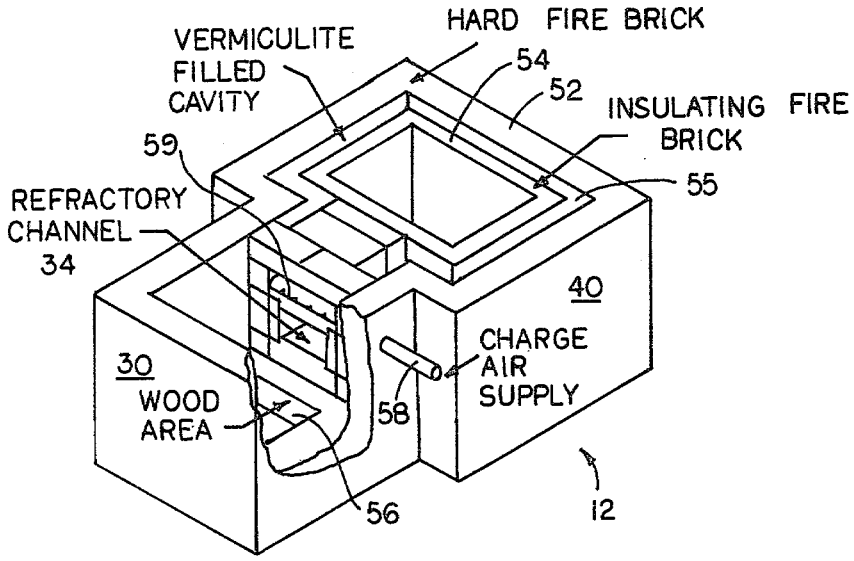
FIG. 3 is a perspective view of the refractory base portion of a furnace system in accordance with the present invention with the combustion chamber base portion partially cut away.
Figure 4:
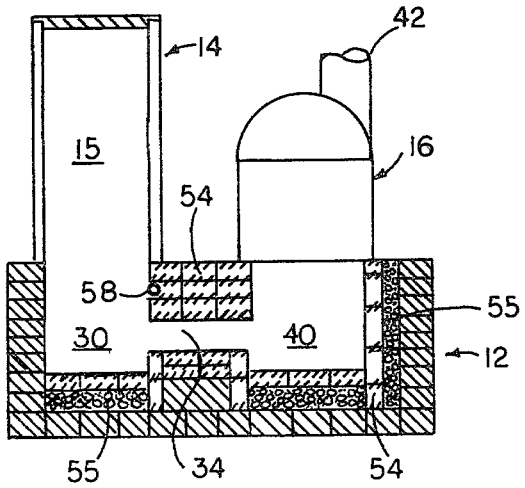
FIG. 4 is a side cross section of the refractory base portion with the water jacket and heat exchanger resting on the refractory base portion.

For a more detailed description of the refractory base portion 12 of furnace system 10, reference is made to FIGS. 3 and 4. In this arrangement, the refractory base portion of the furnace is constructed with an outer wall and floor of hard firebrick 52 surrounding the combustion chamber base 30, heat exchanger base 40 and refractory lined delay channel 34. An inner wall of insulating fire brick or cast insulating refractory 54 lines the refractory channel 34, base support 40 for the heat exchanger and at least the floor of the combustion chamber and entire refractory base section. Between the inner and outer walls or layers 54 and 52 may be formed an additional filler layer 55 of vermiculite for additional refractory insulation. Or a vermiculite cement mixture can be used for the intermediate layer 55. Such a mixture may be formulated from, for example, 8 parts vermiculite, 1 part cement, 3 parts water and 2 parts sand with 6 ounces of air entrainment agent per 100 pound bag of cement. Additionally, hard firebricks 56 may be sunk in the floor of the combustion chamber to provide a hard surface to bear the impact and weight of wood fuel stacked in the combustion chamber. In general, the refractory base section may be cast in situ or assembled from precast bricks and sections.

The charged air or forced air supply tube 58 is preset through the layers or walls along the perimeter of the combustion chamber base for introducing forced air through the row of holes 59 which may alternatively be an elongated slot. The purpose of the reduced outlet size is to achieve high velocity of the charged or forced air producing turbulence and swirling motion of the air throughout the base of the combustion chamber. The swirling of the air not only increases the exposure of gaseous products of wood burning but also increases the retention of the fuel gases in the combustion zone for more complete burning.

Figure 6:
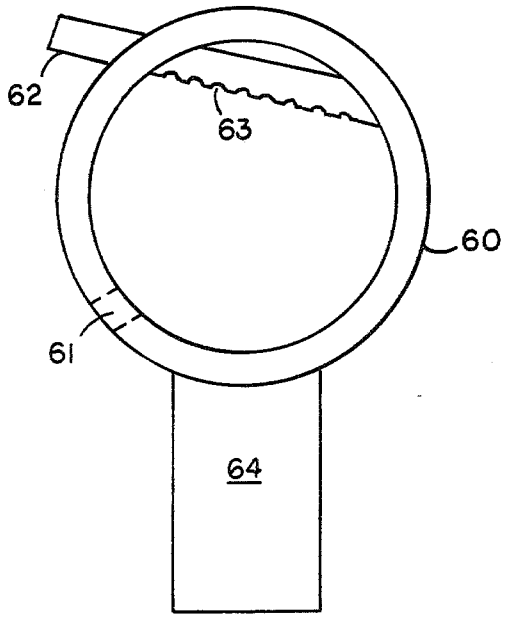
FIG. 6 is a plan view from above of the precast refractory base portion of a combustion chamber for another furnace system embodiment.
Figure 7:
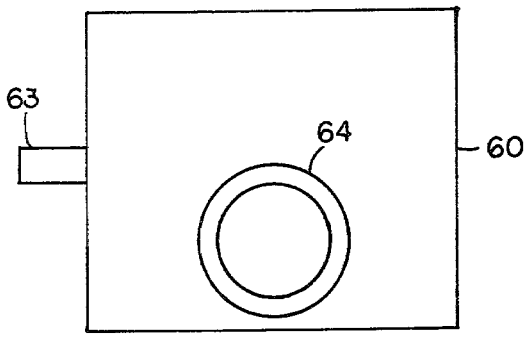
FIG. 7 is a side elevation of the refractory base portion of the combustion chamber showing the laterally directed flue propagation channel.
Figure 8:
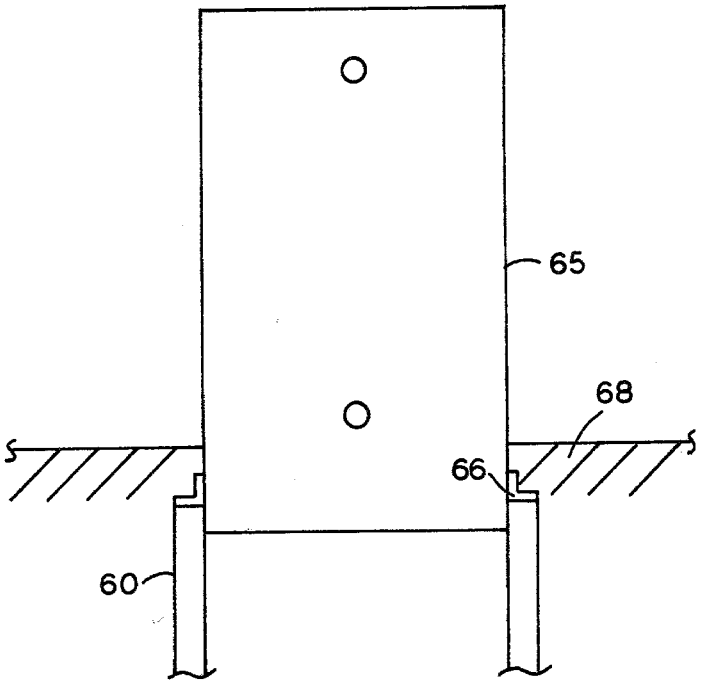
FIG. 8 is a side view of the combustion chamber water jacket and fragmentary portions of the refractory base in partial cross section.

An alternative construction arrangement for the refractory base portion or substructure of the furnace system is illustrated in FIGS. 6 through 9. The combustion chamber base lining is illustrated in FIGS. 6 and 7. As there shown, the combustion chamber base is a precast hollow cylinder 60 of heavy refractory cement such as Plicast 27 refractory cement manufactured by Plibrico, 1800 Kingsbury St., Chicago, Ill., 60614. In this example, the cylinder base is formed with an inner diameter of 16 inches and height approximately the same. Precast and preset through the wall of the base cylinder 60 is the tangentially entering forced air tube or pipe 62 for delivering air under pressure to the row of outlet holes 63 along the perimeter of the cylinder wall at the inner surface of the combustion chamber base. The wall of the cylinder is also formed near its base with a circular hole large enough to accommodate the lateral delay channel cylinder 64.

The flue gas propagation delay line or channel in this embodiment is also lined and bounded by a precast hollow cylinder 64 of heavy refractory cement and in this example is formed with a diameter of 4" to 6". This cylinder for the dimensional context described by way of example here is approximately one foot in length and affords sufficient delay time in the high temperature combustion zone for substantially complete burning of the gaseous products of wood burning. In assembling the furnace structure, the combustion chamber water jacket 65 rests upon the upper edge of cylinder 60 extending slightly into the hollow core of the cylinder, and resting upon the welded tab supports 66. This vertical assembly is then set, sunk, "potted" or enclosed in a light weight refractory insulating cement mixture to the level indicated, for example in FIG. 8, which mixture also covers and surrounds the delay channel 64 and the base support of the heat exchanger as hereafter described with reference to FIG. 9.

Figure 9A:
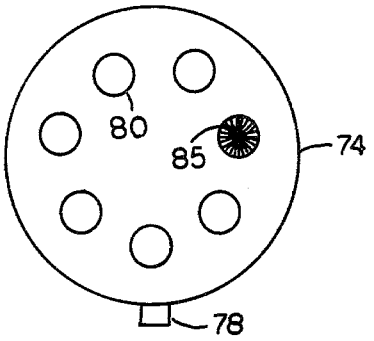
FIG. 9A is a cross sectional view of the heat exchanger in the direction of the arrows on line A—A on FIG. 9, and showing in one of the flue gas heat transfer tubes the turbulator maintained in each tube to introduce turbulence into rising hot flue gases for more efficient heat exchange and for cleaning the tubes as hereafter described.
Figure 9:
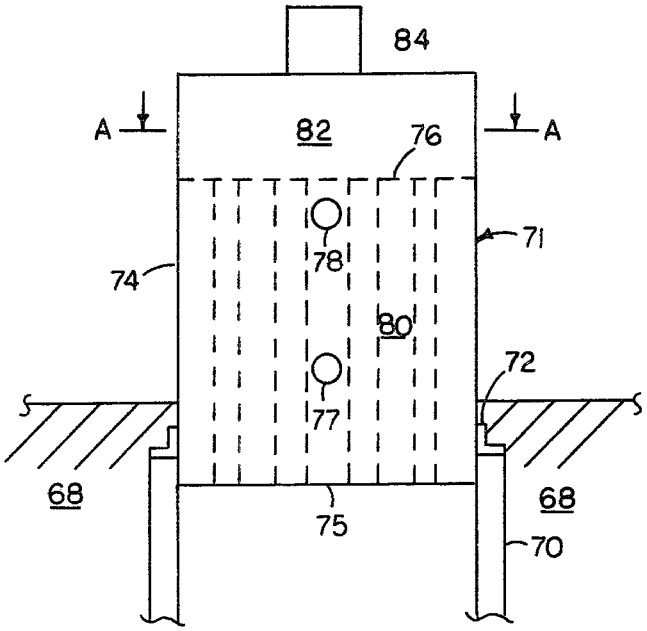
FIG. 9 is a side view of the heat exchanger and fragmentary portions of the refractory base in partial cross section and showing in phantom outline the flue gas heat exchange tubes within the heat transfer fluid convection circulating tank.

As shown in FIG. 9, the welded tabs 72 of the heat exchanger 71 rest upon the upper edge of a precast cylinder 70 similar to that described with reference to FIGS. 6 and 7. Precast cylinder 70 is coupled to the outlet end of channel cylinder 64 and leads to the heat exchange passageways of heat exchanger 70. Cylinder 70 is of course, not formed with a forced air inlet tube as is cylinder 60. The vertical axis cylinders 60 and 70 forming the inner lining, layer or wall of the combustion chamber base and heat exchanger base respectively, coupled by the lateral axis cylinder 64 lining the lateral draft delay channel, are all set or potted in the casting of light weight refractory insulating cement 68. Such a light weight insulating refractory cement mixture can be formed, for example, by mixing 8 parts vermiculite, 1 part cement, 3 parts water and 2 parts sand. Further to increase the insulating value of the mixture, an air entrainment mixture can be added, such as a detergent that foams the mixture, in the ratio of 6 ounces of air entrainment agent per 100 pound bag of cement. This vermiculite/ cement mixture is non-structural and is primarily for insulation purposes, enclosing the sides and bottom of the refractory base portion of the furnace. In order to add structural properties to the surface of the enclosing mixture and to provide a hard durable surface to the base of the furnace, the mixture, once set may be coated with Block-Bond durable fiberglass/cement mixture.

This insulating refractory enclosure for the base portion of the furnace, the combustion and high temperature zone, enables the operative portions of the furnace to be brought quickly up to temperature, for example greater than 1128 degrees F. so that all of the pyrolysis products of wood burning are completely reacted prior to entering the heat exchanger and venting up the chimney. The combustion chamber must also be able to bear the weight of wood logs and elongate pieces of wood on end and so hard firebrick is imbedded in the surface of the insulating vermiculite/cement mixture at the bottom of the combustion chamber to bear the impacts and support the weight of wood. According to another feature high temperature wire such as Nichrome alloy wire coil is bunched at the outlet from the combustion chamber and the beginning of the delay channel to assist in maintaining burning temperatures in the same manner as mantles of a gasoline lamp.

Forced air introduction, in this case through tangential tube 62 and outlet holes 63 in cylinder 60, can be at a number of locations, the objective being to introduce high velocity air for jet stirring in adequate volume for the dimensions of the system, and to balance the draft which is also actively induced. Thus, half the air motion is sought to be achieved by forced air blowing with high velocity stirring of the gaseous products of wood burning, and half the air motion by actively induced draft. In the example above described this balancing and adjustment was set to achieve a rate of volume flow in the stack or flue outlet of 60 cubic feet per minute.

Because the forced air blower operates into an enclosure maintained at below atmospheric pressure by the actively induced draft by as much as 0.3 inches of water pressure, a blower can be used with lower rating than otherwise.

Additional air may also be introduced into the base of the combustion chamber during start up to rapidly bring the combustion zone up to high operating temperatures. To this end air flooding is enabled during start up through an additional hole formed in the base of the cylinder 60. Such a flooding hole position 61 is indicated in dotted lines in FIG. 6 and such flooding hole position permits air in relatively large volume in comparison to the high velocity jets through holes 63. Air flow through hole 61 can be directed radially or tangentially into the interior of the combustion chamber cylinder base 60.

Figure 10:
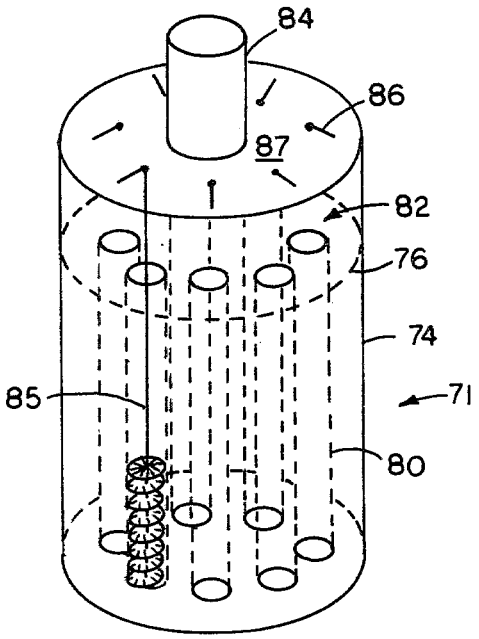
FIG. 10 is a perspective view of the heat exchanger showing in phantom outline one of the turbulators in one of the flue gas heat exchanger tubes and also showing the handles of the turbulators extending outside the top of the heat exchanger to permit reciprocation of the turbulators in the tubes for cleaning.

Another heat exchanger for use in this embodiment of the invention is illustrated in FIGS. 9, 9A and 10. The heat exchanger 71 is formed by a metal cylinder 74 with a bottom plate 75 and top plate 76 within which circulates water or other heat transfer medium by convection received through the inlet 77 and delivered out at higher temperature through outlet 78. Between the bottom plate 75 and the top plate 76 extend a plurality of elongate passageways defined by elongate hollow cylinders 80 joined at the top and bottom plates 75 and 76 at holes formed through the plates so that the flue gas end products can pass from the heat exchanger cylinder base 70 through the water circulating cylinder 74, through a manifold 82 to the chimney or other outlet flue 84.

Another feature of the heat exchanger 71 is shown in FIGS. 9A and 10. According to this feature a plurality of turbulators 85 are provided, one positioned in each flue gas passageway 80 of the heat exchanger. Each turbulator is formed with a helical set of bristles seated within the cylindrical passageway frictionally against the passageway walls and defining a rotating helical passageway for hot gases rising up the passageways thereby introducing greater turbulence, circulation, exposure and retention time for the rising flue gases and greater efficiency and completion of heat transfer from the gases to the water circulating in the heat exchange cylinder. Furthermore, the handle ends 86 extend from inside the heat exchanger through holes in the manifold plate 87 at the top of manifold 82 so that the handle end may be grasped and the stiff steel wire bristles of the brush reciprocated in the passageways 80 for cleaning the passageways of any deposits, thereby serving the dual function as turbulators and cleaning brushes.

While the invention has been described with reference to particular preferred embodiments, it is apparent that a number of variations may also be incorporated within the scope of the invention. For example, the combustion chamber has been described with reference to a vertical axis wall for receiving and supporting wood in a vertical orientation. However, departure from the true vertical is within the contemplation of the invention and the invention contemplates a range of angular variation around the vertical within the limitation that the declivity must be sufficient for gravity to overcome any frictional forces and any coefficient of friction between the generally vertically oriented or stacked wood fuel and the inner surface of the combustion chamber against which the wood fuel rests so that the fuel will feed progressively into the locus of combustion as it burns progressively from the bottom. Furthermore, a variety of heat exchangers may be used for transferring and exchanging heat energy from flue gases to a heat transfer medium. For example, heat exchange and heat transfer from hot gases to air instead of water may also be used and the use of the phrase "heat transfer medium" herein and in the claims is intended to include such variations in heat exchangers such as hot gas to water and hot gas to air. In the case of hot gas to air heat exchange, forced air circulation would probably be used rather than convection circulation as in the case of water. In the case of the combustion chamber water jacket, however, circulation of water or other liquid has been found essential for the quenching action necessary to confine the locus of combustion to the base of the combustion chamber. A variety of refractory construction arrangements may also be used for the base portion of the furnace using refractory materials to achieve the objectives of establishing and maintaining a combustion zone and high temperature retention zone for substantially complete combustion and completion of chemical reactions prior to heat exchange and venting through the flue outlet and chimney. Moreover, while the invention has generally been described with reference to burning wood fuel in the configuration of sticks, logs, or elongate pieces in a vertical orientation or attitude, wood fuel in other configurations may also be used and accommodated such as small pieces or blocks of wood supported in a vertical stack or wood chips gravity fed into the locus of combustion and supported by an appropriate grate arrangement.

Figure 11:
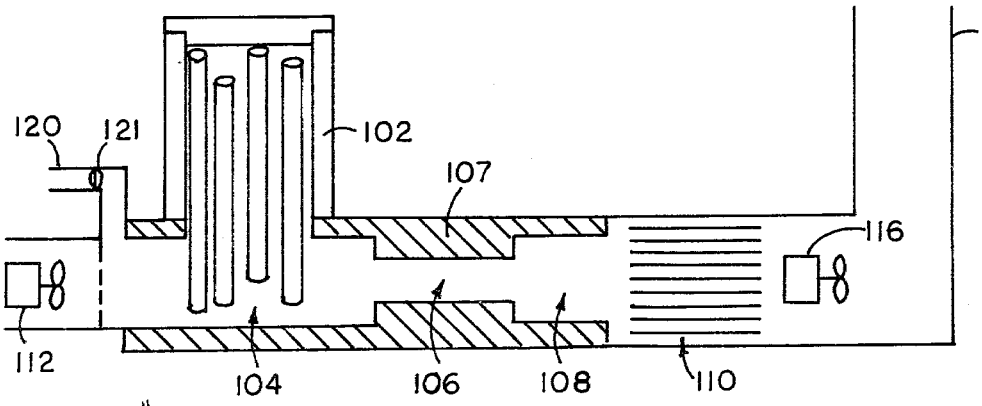
FIG. 11 is a schematic diagram of the furnace system and method of the present invention.

To summarize and further illuminate the principles of the present invention incorporated in the foregoing furnace systems, reference is made to the schematic diagram of the invention illustrated in FIG. 11. As there shown the cooperative elements of the novel furnace system 100 include a vertical or substantially vertical water jacket column 102 for gravity feeding generally vertically oriented logs, sticks, or elongate pieces of wood 103 or wood pieces in a vertical stack such as wood blocks or wood chips into a generally horizontal or lateral furnace sequence as follows. The gravity fed wood fuel settles into a combustion chamber refractory base portion 104 which forms the locus of combustion in the lateral or substantially horizontal sequence. Actual burning of the fuel is confined to the base 104 and does not ascend the wood fuel column by reason of the quenching action of the water jacket, the laterally directed draft away from the fuel, and the air tight enclosure over the fuel.

Downstream from the locus of wood fuel combustion and the combustion chamber refractory base portion 104 is the restricted channel 106 bounded by the refractory material 107. The relatively more restricted diameter of this refractory channel 106 causes an increase in the velocity of flue gases drafted from the combustion chamber, but the increased length of the refractory channel path introduced by channel 106 delays the entry of the flue gas into the heat exchanger 110 by increasing the travel time in a high temperature environment. The high temperature is maintained by the insulating properties of the refractory material 107 along and around the horizontal or lateral furnace sequence. It is in this sense that the refractory channel is a flue gas propagation delay channel in that it imposes a delay in the flue porpagation by increasing time in a high temperature refractory environment sufficient to permit substantially complete combustion of the pyrolysis products of wood burning prior to entry into the heat exchanger. Thus, as used herein and in the following claims the phrases "delay channel" and "flue propagation delay channel" refer to such a channel which increases travel time of the flue gas in a high temperature environment or passageway bounded by refractory material and whose relatively restricted diameter increases flue gas velocity for increased stirring and exposure to the introduced forced air hereafter described. The increased travel time delay channel 106 is directed generally laterally away from the locus of combustion 104.

Upstream from the locus of wood fuel combustion and the combustion chamber base 104 is forced air blower 112 which forces air under pressure, for example of 3" of water above atmospheric pressure, at high velocity through restricted orifices 113 into the combustion region. The restricted orifices might be, for example a row of ten holes ¼" in diameter or an elongate slit. This forced air, with a velocity of, for example 100 feet per second, jet stirs the fuel gases with turbulent mixing so that the air and fuel gas mixture propagates down the channel 106 for the delayed time interval during which secondary burning completes the chemical reaction of the wood burning pyrolysis products to the end products of combustion. The hot reacted gases enter the refractory insulated manifold region 108 for delivery into the passageways of heat exchanger 110 and distribution over those passageway inlets.

Downstream from the heat exchanger 110 and leading into the chimney or flue outlet 114 is the draft fan 116 for actively inducing a draft and low pressure region through the lateral or horizontal furnace sequence and heat exchanger. The relationship of the draft inducing fan 116 and the forced air blower 112 is important to the concept of the invention and is here described with additional reference to the pressure chart 11A shown below FIG. 11 and correlated with the regions of the lateral furnace sequence.

Draft fan 116 actively induces low pressure inside the flue path in the range of, for example, from 0.3 (three tenths) inches below atmospheric pressure to 0.7 (seven tenths) inches below atmospheric pressure. This is some ten to a hundred times lower pressure than can be achieved by natural draft alone. This actively induced draft and low pressure established in the lateral furnace sequence flue path offers three advantages. First, it permits top feed of fuel through the air tight cover 115 into column 102 without backdraft of smoke. Second it assures that leakage through any cracks or joints will be from the outside air into the furnace rather than from the inside out, and third it permits efficient heat recovery through an extended surface area heat exchanger and low stack temperatures. To expand the latter point, the induced pressure differential permits drawing the draft gases through a more extended heat exchange surface area for more efficient and complete energy recovery than is possible with a naturally induced draft. As a result stack temperatures are lower, for example in the order of 300° F. to 350° F.

Figure 11A:
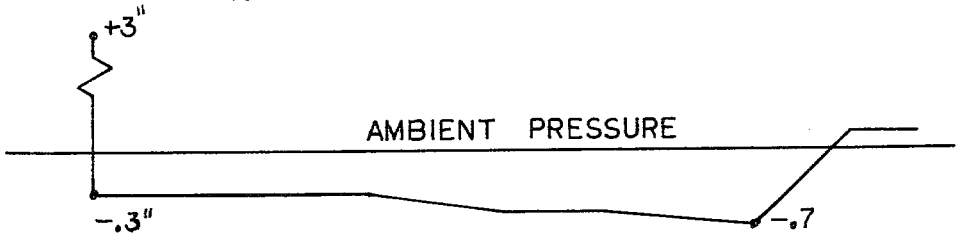
FIG. 11A is a graph of the pressure gradients established along the furnace sequence of FIG 11.

Establishing low pressure in the refractory sequence of the furnace by actively induced draft is also important in relation to the forced air as it permits forcing air at relatively high pressure, of for example 3 (three) inches of water above atmospheric pressure, through restricted orifices at high velocity into the combustion chamber without smoke leaking out of any cracks or imperfect joints. Without the actively induced draft, forced air would pressurize the refractory section of the furnace and it would have to be carefully hermetically sealed and air tight through to the chimney outlet. According to the present invention, however, the pressure sequence contemplated is as illustrated by way of example in FIG. 11A. As there shown, the pressure upstream from the combustion chamber and up to the restricted orifice high velocity outlet or outlets 113, is, for example, three inches of water above atmospheric or ambient pressure. The mechanical impedance of inlets 113 occasions the pressure drop to that established in the combustion chamber by induced draft fan 116 and generally in the order of three tenths of an inch of water below atmospheric pressure or ambient pressure. The pressure further falls through the restricted diameter of the flue propagation channel 106 and extended surface area passageways of the heat exchanger 110 to the minimum pressure at the draft fan 116, which lower pressure is, for example, approximately seven tenths of an inch of water below atmospheric or ambient pressure. Immediately downstream from fan 116 the pressure of course rises slightly above atmospheric or ambient pressure supplying "buoyancy" in the vertical stack or chimney.

During start up or initiation of a burn in the combustion chamber and to some extent during operation of the furnace the invention provides flow of air through a low resistance air entry or flooding port 120 into the combustion chamber downstream from the high resistance restricted orifice entry 113. This low resistance relatively large opening 120 is provided with a valve, door, or adjustable closure 121 which is open during start up to permit a large volume of air to be drawn in by draft fan 116 to facilitate initiation of the burning of wood fuel in the locus of combustion. Once the fire is established the invention contemplates adjusting the floding air hole or port closure in relation to the operation of the forced air blower 112 and induced draft fan 116 so that the forced air blower supplies through the restricted high velocity orifice or orifices 113 approximately at least half the air volume flowing through the furnace sequence, the remaining air entering through the air flooding port drawn by the low pressure in the combustion chamber in turn established by the draft fan 116. This balancing of the forced air and the draft air contemplated and accomplished by the present invention has been found essential to highly efficient and complete combustion. More particularly, at least half the air volume flow should originate from the high velocity jet stirring air. The forced air blower 112 supplies high velocity air of 100 feet per second or greater for jet stirring and turbulent mixing amounting to at least half the air passing through the furnace sequence and flue by creating a low pressure environment in the furnace and drawing air through a low resistance port provided for that purpose. It has been found that a significant proportion of the air amounting to at least half the air flow volume must be in the high velocity stirring mode for high efficiency burning and heat recovery. All the air may be supplied by the forced air blower 112 in the stirring mode but this requires higher forced air pressure and a higher capacity forced air blower 112. In that event the flooding port would not be necessary and all the air for complete combustion would enter through the restricted orifices 113.

However, it has been found that the objectives of the invention namely efficient and complete combustion followed by efficient and high recovery of energy through heat exchange can be accomplished as long as the forced high velocity air comprises at least half the air volume required and flowing through the furnace sequence. With a combustion chamber having a water jacket 30" high and 16" in diameter and a refractory base 9" high; a lateral draft from the base leading to a delay travel time refractory channel 4" in diameter and approximately one foot long; with a pressure gradient established as in FIG. 11A delivering approximately 60 cubic feet per minute of air flow; with forced air through high resistance restricted entry orifices formed by 10 holes ¼" in diameter in a length of one inch diameter pipe supplying about half the air flow through the furnace sequence; with draft fan in the range of 1/20th to ½ horsepower drawing the remaining air through a low resistance air flooding opening 1¼" in diameter appropriately regulated to balance the forced air and draft air; and with a heat exchanger as described above; the furnace produced a steady state burn consuming approximately 20 pounds of wood per hour, with an output of 100,000 BTU's per hour with a combustion zone temperature of 1800° F. and stack temperature of 350° F.

I claim:

1. A new and improved stove or furnace for efficient combustion of wood fuel in the form of sticks, logs or other elongate pieces of wood or wood in a vertical stack and for extraction of heat from the hot gaseous end products of combustion comprising:

substantially vertical feed combustion chamber means forming an upright column for receiving and supporting wood fuel in a generally vertical attitude or stack, said combustion chamber means being substantially air tight and formed with a draft outlet at the base of the combustion chamber means, a major upper portion of the combustion chamber means comprising water jacket means with means for coupling said water jacket means to a source of water or other heat transfer fluid for at least convection circulation of water or fluid through the water jacket means for quenching combustion in the upper portion and for confining the locus of wood fuel combustion to the base portion of the vertical feed combustion chamber means, said base portion comprising refractory heat confining material for high temperature efficient combustion;

flue gas propagation delay channel means extending from the draft outlet at the base of the combustion chamber, said delay channel comprised of refractory heat confining material;

heat exchange means coupled to the outlet of the delay channel means for receiving the hot gaseous end products of wood combustion and transferring heat from the hot gases;

means for inducing a draft of flue gas and combustion air from the base of the combustion chamber means through the delay channel means and heat exchange means;

said flue gas propagation delay channel means affording delayed propagation of the flue gas and air mixture in a high temperature environment sufficient to afford substantially complete secondary burning of the gaseous products of combustion prior to heat transfer in the heat exchange means.

2. A new and improved stove or furnace for efficient combustion of wood fuel in the form of sticks, logs or other elongate pieces of wood, or wood in a vertical stack, and for extraction of heat from the hot gaseous end products of combustion comprising:

combustion chamber means with substantially vertical axis forming an upright column, said combustion chamber means comprising a base portion of refractory material forming the locus of wood fuel combustion, and water jacket means defining at least a major portion of said upright column positioned over the combustion chamber base portion and forming a substantially air tight enclosure over the base portion, said combustion chamber refractory base portion and said water jacket means in combination defining a vertical feed combustion chamber for receiving elongate pieces of wood or wood in a vertical stack with the bottom of the wood fuel resting in the refractory base portion so that the wood fuel is gravity fed into the locus of wood fuel combustion by burning progressively from the bottom;

heat exchange means for receiving and conducting the hot gases of wood fuel combustion for heat exchange from the hot flue gases to a heat transfer medium circulating through the heat exchange means;

a channel bounded by refractory material extending laterally from the refractory base portion of the combustion chamber means to the heat exchange means;

means for inducing a draft from the vertical feed combustion chamber refractory base portion through the laterally extending refractory channel for directing the products of wood fuel combustion through the refractory channel means;

means for admitting air into the combustion chamber refractory base portion to effect turbulent mixing and swirling of air with the gaseous products of combustion and so that a turbulent mixture of air and fuel gas follows the draft from the refractory base portion of the combustion chamber means through the laterally directed refractory channel;

said refractory channel affording a high temperature environment and delayed propagation of the flue gas and air mixture sufficient to afford efficient and substantially complete secondary burning of the gaseous products of combustion with the turbulent air admitted into the combustion chamber base portion, prior to heat transfer in the heat exchange means;

means for coupling said combustion chamber water jacket means to a source of water or other heat transfer medium for at least convection driven circulation of the water or medium;

said water jacket means over the combustion chamber base portion and said laterally directed draft from the combustion chamber base portion combining to confine the locus of wood fuel combustion to the refractory base portion of the chamber means and the bottom of the elongate pieces of wood or wood stack supported generally vertically in the combustion chamber means thereby preventing the burn from ascending into the upright column of the chamber means.

3. A new and improved furnace for efficient combustion of wood fuel and extraction of heat comprising:

combustion chamber means with substantially vertical axis forming an upright column, said combustion chamber means comprising a base portion of refractory material forming the locus of wood fuel combustion, and water jacket means in a configuration forming a major portion of the walls of said upright column positioned over the combustion chamber base portion and formed with substantially air tight cover means over the column, said combustion chamber refractory base portion and said water jacket means in combination defining a substantially vertical feed combustion chamber for receiving elongate pieces of wood or stacks of wood fuel with the bottom of the elongate pieces or stacks of wood fuel resting in the refractory base portion so that wood fuel is gravity fed into the locus of combustion while burning progressively from the bottom;

heat exchange means comprising a base portion of refractory material for receiving and insulating the hot gases of wood burning, and a heat exchanger positioned over the refractory base portion for receiving and conducting the hot gases of wood fuel combustion for heat exchange from the hot flue gas to water or other heat exchange receiving fluid circulating through the heat exchanger;

channel means bounded by refractory material extending laterally from the refractory base portion of the combustion chamber means to the refractory base portion of the heat exchange means;

means for inducing a draft from the vertical feed combustion chamber refractory base portion through the laterally extending refractory channel, refractory heat exchange means base portion and heat exchanger for directing the products of wood fuel combustion through the refractory base portions of the furnace;

means for admitting air at high velocity into the combustion chamber refractory base portion to effect turbulent mixing and swirling of air with the gaseous products of wood fuel combustion and so that a turbulent mixture of air and fuel follows the draft from the refractory base portion of the combustion chamber through the laterally directed refractory channel to the base portion of the heat exchange means;

said refractory channel affording a high temperature environment and delayed propagation of the flue gas and air mixture sufficient to afford efficient and substantially complete secondary burning of the gaseous products of wood burning with the turbulent air forced into the combustion chamber base portion, and prior to heat transfer in the heat exchange means;

means for coupling said combustion chamber water jacket means to a source of water or other heat transfer fluid for at least convection driven circulation of water or fluid between the water jacket means and the source of water or fluid;

said water jacket means over the combustion chamber base portion and said laterally directed draft from the chamber base portion combining to confine and restrict the locus of wood fuel combustion to the refractory base portion of the combustion chamber means and to the bottom of elongate pieces or stacks of wood fuel supported in the chamber means thereby preventing the burn from ascending into the upright column of the combustion chamber means.

4. A new and improved furnace as set forth in claim 3 wherein is also included in the base of the combustion chamber means, air flooding inlet means for flooding the locus of combustion with air during initiation of a burn in the chamber.

5. A new and improved furnace as set forth in claim 3 wherein said means for inducing a draft from the refractory base portion of the combustion chamber means through the lateral channel comprises active blower means.

6. A new and improved furnace as set forth in claim 3 further comprising means for forcing air into the combustion chamber base portion comprising active blower means and forced air inlet means at the periphery of the combustion chamber base portion for directing high velocity air into the chamber means and for turbulence and swirling motion of the air with the gaseous products of wood burning.

7. A furnace as set forth in claim 6 wherein said combustion chamber base portion is circular in cross section to facilitate swirling motion of the forced air and gaseous fuel mixture.

8. A furnace as set forth in claim 3 wherein hard fire brick is imbedded or positioned in the inside surface of the bottom of the combustion chamber base portion to withstand the weight and impact of elongate pieces of wood fuel received and vertically supported in the chamber.

9. A furnace system as set forth in claim 3 wherein said heat exchanger comprises a plurality of flue conducting tubes in a heat transfer medium circulating chamber, and wherein each tube contains a turbulator frictionally contacting the inner surface of the tube and having handle means extending outside the heat exchanger whereby the turbulator can be reciprocated within the tubes for cleaning by retraction and extension of the handles and whereby the turbulators introduce turbulence into the hot flue gases passing through the multiple tubes of the heat exchanger.

10. A new and improved furnace for efficient combustion of wood fuel and extraction of heat comprising:

a refractory base portion including a combustion chamber base of refractory material forming the locus of wood fuel combustion, a channel bounded by refractory material extending laterally away from the combustion chamber base, and a heat exchanger base of refractory material for supporting heat exchange means and receiving and insulating the hot exhaust gas of wood fuel combustion from the refractory channel for delivery to the heat exchange means;

combustion chamber water jacket means forming at least a major portion of the walls of a substantially vertical column positioned over the combustion chamber base and formed with a substantially air tight cover means over the column, said substantially vertical column water jacket means and combustion chamber base in combination defining a substantially vertical feed combustion chamber for receiving through the air tight cover elongate pieces of wood fuel or wood in a vertical stack and for supporting said wood fuel in a vertical attitude with the bottom of the wood fuel resting in the refractory combustion chamber base whereby elongate pieces of wood or wood in a vertical stack are gravity fed into the locus of wood fuel combustion in the chamber refractory base while burned progressively from the bottom;

heat exchanger means positioned over the heat exchanger base for receiving and conducting the hot gases of wood fuel combustion, said heat exchanger means comprising extended flue gas passageway means defining extended surface area for heat exchange from the hot flue gas to water or other heat receiving medium circulating through the heat exchanger means;

means for coupling said combustion chamber water jacket means to a source of water or other heat transfer fluid for at least convection driven circulation of the water or fluid between the water jacket means and the source of water or fluid;

means for coupling said heat exchanger means to a source of water or other heat transfer medium for circulation of the water or other medium between the heat exchanger means and the source of water or other medium;

means for establishing a draft from the vertical feed combustion chamber through the laterally extending refractory channel, refractory heat exchanger base, and heat exchanger for directing the products of wood fuel combustion through the refractory portion of the furnace;

means for forcing air into the combustion chamber refractory base at relatively high velocity to effect turbulent mixing and swirling of air with the gaseous products of primary wood burning whereby said turbulent fuel gas and air mixture follows the draft from the combustion chamber refractory base through the laterally directed refractory channel to the base of the heat exchanger;

said refractory channel affording a high temperature environment and delayed propagation of the flue gas and air mixture sufficient to afford highly efficient and substantially complete secondary burning of the gaseous products of wood fuel combustion with the turbulent air forced into the combustion chamber base;

said vertical column water jacket means over the combustion chamber base, and laterally directed draft away from the combustion chamber base combining to confine and restrict the locus of wood fuel combustion to the refractory base portion of the combustion chamber, thereby preventing the burn from ascending vertically into the column of the combustion chamber.

11. A new and improved furnace as set forth in claim 10 wherein is also included in the base of the combustion chamber means, air flooding inlet means for flooding the locus of combustion with air during initiation of burning in the combustion chamber means.

12. A new and improved furnace as set forth in claim 10 wherein said means for establishing draft through the refractory portion of the furnace comprises active blower means.

13. A new and improved furnace as set forth in claim 10 wherein said means for forcing air into the combustion chamber means comprises active blower means and reduced orifice forced air inlet means at the periphery of the combustion chamber base for directing air at high velocity into the chamber means and for turbulence and swirling motion of the air.

14. A furnace as set forth in claim 13 wherein said combustion chamber base is circular in cross section to facilitate swirling motion of the forced air and fuel gaseous mixture.

15. A furnace as set forth in claim 10 wherein said refractory base of the furnace is formed with at least one layer of light weight insulating refractory material and at least one layer of heavier weight structural refractory material.

16. A furnace as set forth in claim 10 or claim 15 wherein hard fire brick is imbedded or positioned in the inside surface of the bottom of the combustion chamber base to withstand the weight and impact of elongate pieces of wood fuel received and vertically supported in the combustion chamber means.

17. A furnace as set forth in claim 10 wherein said refractory portion of the furnace comprises a first substantially vertical axis cast hollow cylinder of heavy refractory cement forming the inner lining of the combustion chamber base, a second substantially vertical axis cast hollow cylinder of heavy refractory cement forming the inner lining of the heat exchanger base, a third elongate hollow cast cylinder of smaller diameter and substantially lateral axis orientation forming the lateral channel between the combustion chamber base and the base of the heat exchanger, said first second and third hollow cylinders embedded in a casting of light weight insulating refractory mixture.

18. A furnace as set forth in claim 17 wherein said light weight insulating refractory mixture comprises predominantly vermiculite.

19. A furnace as set forth in claim 18 wherein hard fire bricks are imbedded in the inside surface of the bottom of the combustion chamber base better to withstand the impact and weight of elongate pieces of wood received and vertically supported in the combustion chamber means.

20. A furnace as set forth in claim 10 wherein the refractory portion of the furnace comprises a multi-layered structure comprising an outer layer of hard refractory material, an inner layer of intermediate weight insulating refractory material, and a middle layer of light weight insulating refractory material, and wherein hard fire bricks are imbedded in the inside surface of the bottom of the combustion chamber means.

21. A furnace as set forth in claim 10 wherein said heat exchanger means comprises a plurality of flue conducting tubes in a heat transfer medium circulating chamber, and wherein each tube contains a turbulator frictionally contacting the inner surface of the tube and having a handle extending outside the heat exchanger whereby the turbulators can be reciprocated within the tubes for cleaning by retraction and extension of the handles and whereby the turbulators introduce turbulence into the hot flue gases passing through the muliple tubes of the heat exchanger means.

22. A furnace as set forth in claim 10 wherein is provided a source of water or other heat transfer fluid coupled for convection circulation of said fluid through the combustion chamber water jacket means and through said heat exchange means in parallel fluid circuits, said source adapted to confine the heat transfer fluid at ambient atmospheric pressure.

23. A furnace as set forth in claim 22 wherein is also provided a domestic hot water supply heat exchanger and heat transfer fluid circuit in parallel with the combustion chamber water jacket means, heat exchange means, and source of heat transfer fluid, and wherein is also provided fluid pump means in the heat transfer fluid circuit of the domestic hot water heat exchanger for increasing the rate of heat exchange to the domestic hot water supply.

24. A furnace as set forth in claim 10 wherein said means for forcing air at high velocity into the combustion chamber means delivers at least half the air flow volume through the refractory base portion of the furnace.

25. A furnace as set forth in claim 24 wherein said high velocity forced air means and said means for establishing a draft are balanced to deliver approximately equal portions of the air flow through the furnace.

26. A new and improved furnace system for high efficiency combustion of wood or other solid fuel and high efficiency energy recovery from the end products of combustion comprising:

a substantially vertical column combustion chamber, the major upper portion of said vertical column comprising a water jacket for at least convection circulation of water or other heat transfer fluid, the base portion of said combustion chamber comprised of refractory material forming the locus of combustion, said combustion chamber adapted to receive and support elongate pieces of fuel in a vertical attitude or fuel pieces in a vertical stack and confine combustion to the chamber base by the quenching action of the water jacket, said combustion chamber formed with a draft outlet at the base of the chamber;

said combustion chamber base and locus of combustion forming part of a furnace sequence in a refractory high temperature environment, said furnace sequence comprising in order from upstream to downstream in the air and flue gas flow as follows:

means for forcing air at relatively high pressure above ambient pressure and at high velocity through restricted orifice means into the combustion chamber for jet stirring and turbulent mixing, low resistance air entry means into said combustion chamber and means for controlling said air entry means, said combustion chamber refractory base portion as enumerated above, flue gas propagation delay channel means bounded by refractory material for maintaining a high temperature environment, for directing flue gas away from the base of the combustion chamber, and for increased retention time of the flue gas and forced air mixture in the high temperature environment for completion of combustion chemical reactions prior to heat extraction from the flue gas, refractory insulated manifold means for receiving the hot end products of combustion and for distribution of the hot gases over heat exchange means;

heat exchange means coupled to said refractory manifold and refractory furnace sequence output downstream from the delay channel means for recovering energy from the hot gaseous end products of combustion;

and means for inducing draft and establishing a low pressure gradient in the furnace sequence.

27. A furnace system as set forth in claim 26 wherein said jet stirring high velocity forced air means delivers at least half the air flow volume through the furnace sequence.

28. A furnace system as set forth in claim 27 wherein said high velocity forced air means and said induced draft means are balanced to deliver approximately equal portions of the air flow through the furnace, said induced draft means drawing air through the low resistance air entry means.

29. A new and improved furnace for efficient combustion of wood fuel in the form of sticks, logs or other elongate pieces of wood or wood pieces in a vertical stack, and for extraction of heat from the hot gaseous end products of combustion comprising:

vertical feed combustion chamber means forming an upright column for receiving and supporting wood fuel in a substantially vertical attitude or stack, said combustion chamber means being substantially air tight and formed with a laterally directed draft outlet at the base of the combustion chamber means, a major upper portion of the combustion chamber means comprising water jacket means with means for coupling said water jacket means to a source of water or other heat transfer fluid for at least convection circulation of water or fluid through the water jacket means for confining the locus of wood fuel combustion to the base of the vertical feed combustion chamber means, the lower portion of said combustion chamber means comprised of refractory heat confining material to provide high temperature and efficient combustion, said combustion chamber means formed with combustion air inlet means;

high temperature refractory flue gas channel means extending from the laterally directed draft outlet of the vertical feed combustion chamber means affording delayed propagation of flue gas in a high temperature environment sufficient to afford substantially complete secondary burning of the gaseous products and constituents of primary combustion with combustion air;

and heat exchange means coupled to the delayed propagation channel means for transferring heat from gaseous end products of substantially complete wood fuel combustion.

* * * * *